United States Patent [19]

Lautenschläger

[11] Patent Number: 4,584,738

[45] Date of Patent: Apr. 29, 1986

[54] CROSSLINK HINGE WITH A GREATER OPENING OUTTHRUST

[75] Inventor: Reinhard Lautenschläger, Reinheim, Fed. Rep. of Germany

[73] Assignee: Karl Lautenschlager KG, Mobelbeschlagfabrik, Reinheim, Fed. Rep. of Germany

[21] Appl. No.: 704,184

[22] Filed: Feb. 22, 1985

[51] Int. Cl.[4] ..... E05D 7/04

[52] U.S. Cl. ..... 16/238; 16/246; 16/354; 16/364; 16/370

[58] Field of Search ..... 16/238, 245, 246, 354, 16/364, 370, 382

[56] References Cited

FOREIGN PATENT DOCUMENTS 2459346 7/1976 Fed. Rep. of Germany ..... 16/354

1559893 6/1978 Fed. Rep. of Germany ..... 16/354

*Primary Examiner*—Fred Silverberg

[57] ABSTRACT

The supporting-wall-related part of the hinge is composed of a bottom piece and a top piece borne on the bottom piece and displaceable relative to the latter, horizontally into and out of the carcass interior. One of the link arms of the crosslink mechanism is directly pivotable on the front end of the top piece, i.e., the doorleaf end thereof, and one end of a lever is articulated on its rearward end portion pointing into the carcass interior while its other end is articulated to the rearward end of the other link arm. On the end of the lever that is articulated to the top piece a gear segment is formed, which meshes through an opening in the top piece with a rack provided on the bottom piece.

8 Claims, 5 Drawing Figures

CROSSLINK HINGE WITH A GREATER OPENING OUTTHRUST

BACKGROUND OF THE INVENTION

The invention relates to a crosslink hinge for hanging a door which is to be opened by more than 90°, preferably by as much as 180°, on the supporting wall of the carcass of a piece of furniture. The door-related part and the supporting-wall-related part, the latter adjustably fastenable to a mounting plate preinstalled on the supporting wall, are interconnected by two link arms joined for pivoting relative to one another in their middle area. One end of one of the two link arms is directly articulated to one of the hinge parts and the other is directly or indirectly coupled with the other hinge part. The carcass-interior end of the link arm that is attached directly at its front end to the door-related part is coupled to the supporting-wall-related part by a swinging lever.

A door mounted with such crosslink hinges (German Federal Pat. No. 22 19 616) on the supporting wall of a cabinet carcass can be opened as much as 180°, in which case the kinematics of the hinge superimpose on the door, while it is swinging to the open position, a component of movement outwardly from the carcass interior, so that the opened door—in the case, for example, of built-in cabinets—stops in front of the adjacent door of the next cabinet. These crosslink hinges have proven practical, yet they have been usable heretofore only in cases in which the above-mentioned component of movement out of the carcass interior does not exceed a certain dimension. In the case of cabinets with projecting moldings or with recessed doors, however, the known crosslink hinges cannot be used, because they do not carry the door far enough out of the cabinet interior when it opens, so that it can pass around a projecting molding, for example. Basically, it would be possible to make the known crosslink hinges such that the door will open with a greater outthrust, i.e., the component of movement out of the carcass interior, by increasing the length of the lever arms of the link levers and swinging levers accordingly. This, however, would necessarily result in a considerable enlargement of size and would make such crosslink hinges look clumsy. Crosslink hinges have therefore been developed (AT Pat. No. 342,999), in which coupled kinematic members are additionally provided on the supporting-wall side, which, by the application of the Nuremberg shear principle, considerably increase the outthrust upon opening. But these known hinges, too, have necessarily larger dimensions than normal crosslink hinges and due to the extended lever arms and the additional kinematic members they all have a reduced load-bearing capacity unless their individual parts are made heavier.

In contrast, the invention is addressed to the problem of improving the known crosslink hinges such that, with substantially unchanged dimensions and unchanged load-bearing capacity, they will have a decidedly greater component of movement outwardly from the cabinet carcass, so that they will be suitable especially for recessed doors or also for doors which have to be swung around projecting moldings, frames or the like.

BRIEF SUMMARY OF THE INVENTION

Setting out from a crosslink hinge of the kind mentioned above, this problem is solved in accordance with the invention in the following manner: the supporting-wall-related part is composed of a bottom piece which can be fastened in the conventional manner on a mounting plate, and a top piece which can be slidingly guided on the bottom piece horizontally into and out of the carcass interior; the associated link arm is directly pivoted on the front end, i.e., the end adjacent the door, of the top piece, and the supporting-wall end of the swinging lever is pivoted in its carcass-interior end portion. A gear segment is formed on the end of the swinging lever that is linked to the top piece and meshes with a rack section provided on the bottom piece. The additional outthrust is therefore achieved by the longitudinal displaceability of the top piece on the bottom piece of the two-piece supporting-wall-related hinge part, the meshing of the teeth provided on the segment pivotally mounted on the top piece with the rack provided on the bottom piece assuring a positive coupling of the movement of the top and bottom piece in proportion to the opening angle.

In a preferred embodiment of the invention, the top piece of the supporting-wall-related part has an elongated shape of inverted U-shape cross section, the two lateral flanges of the top piece closely straddling the lateral surface of the likewise elongated bottom piece and catching the bottom edge of the lateral surfaces of the bottom piece with longitudinal edges turned in toward each opposite flange. The longitudinal edges thus secure the top piece against lifting away from the bottom piece, while they permit the desired longitudinal displacement.

The flanges of the top piece, in an advantageous further development of the invention, have pivot lugs projecting above the web in the rear pivot area of the swinging lever, and the web itself has an opening in the area between the pivot lugs so that the gear segment provided on the end of the swinging lever pivoted between the pivot lugs will engage, through the opening, the rack section provided on the top of the bottom piece.

If the crosslink hinge of the invention is to be able to be installed by sliding it horizontally, parallel to the supporting wall, onto the mounting plate previously installed on the cabinet carcass, in the manner known from German Offenlegungsschrift No. 28 19 100 in four-pivot hinges, the supporting-wall-related part has at its end pointing into the carcass interior an open-ended slot through which passes the shank of a locking screw threaded into the mounting plate, and a tap is provided offset towards its front end—i.e., the end pointing outwardly from the carcass interior—and into it a threaded stud is driven which bears on its bottom end adjacent the mounting plate a locking head of enlarged diameter which is inserted into an open slot having a narrowed opening securing the locking head against lifting. The configuration is such, in an advantageous further development, that the slot and the tap are provided in the bottom piece of the supporting-wall-related part, and that the gear segment of the swinging lever is relieved in the middle portion passing over the slot in the hinge opening and closing movement. The relief is of a width corresponding approximately to the diameter of the head of the fastening screw passing through the slot, such that the head can pass through under the relieved middle portion.

The top piece of the supporting-wall-related hinge part is desirably made, like the bottom piece too, integrallly of metal by the die-casting process. To avoid the excessively complex casting dies which would be needed for making an integral top piece, the top piece of the supporting-wall-related part can also be composed of two mirror-image symmetrical halves divided along the longitudinal central plane between and parallel to the flanges. These halves are then best joined together by rivets or screws passing through bores didposed at right angles to their plane of separation.

BRIEF DESCRIPTION OF THE DRAWINGS

The invention is further explained in the following description of an embodiment, in conjunction with the drawing, wherein.

DETAILED DESCRIPTION OF A PREFERRED EMBODIMENT

Figure 1:
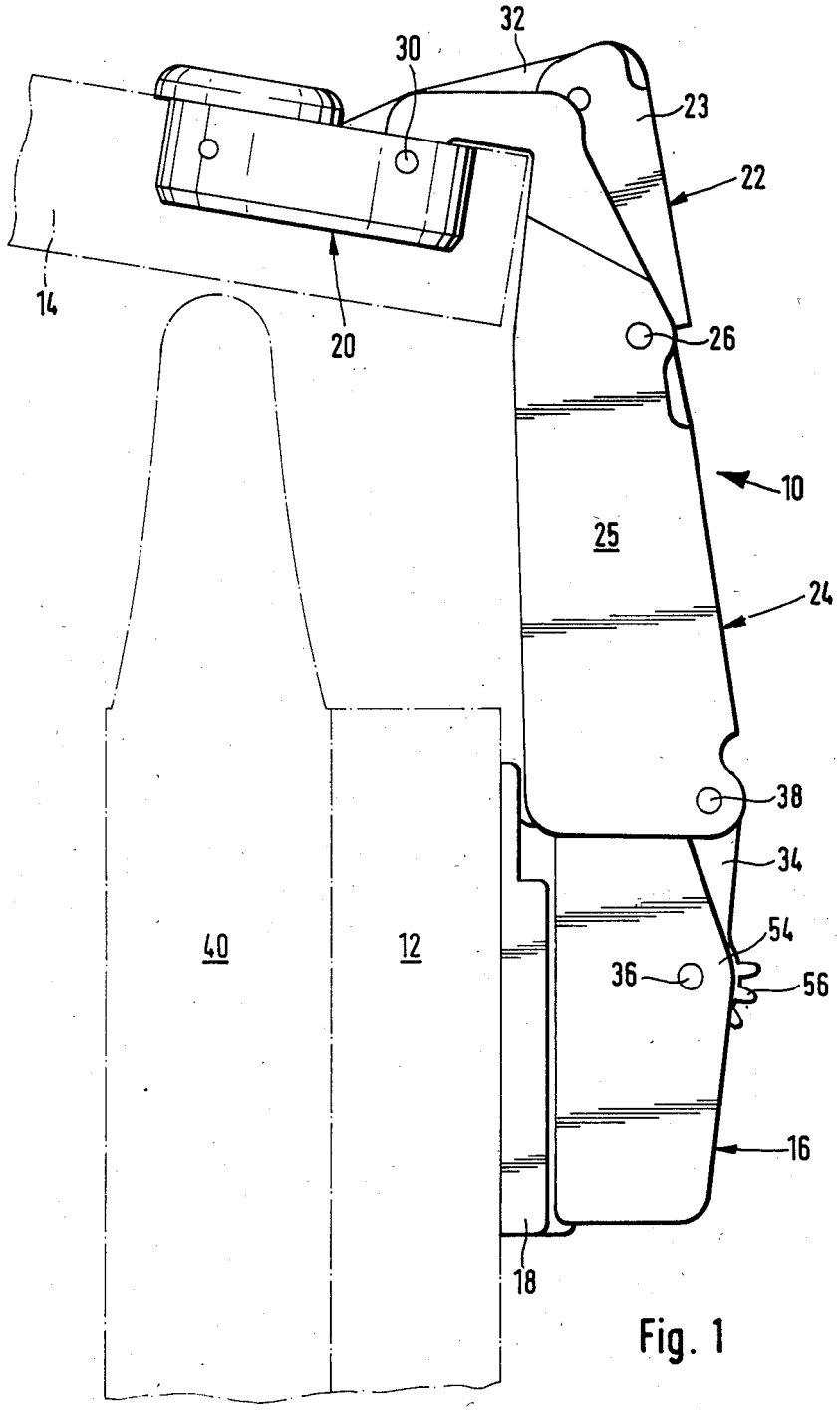
FIGS. 1 and 2 are side views of the crosslink hinge of the invention, in the open and closed position, respectively.
Figure 2:
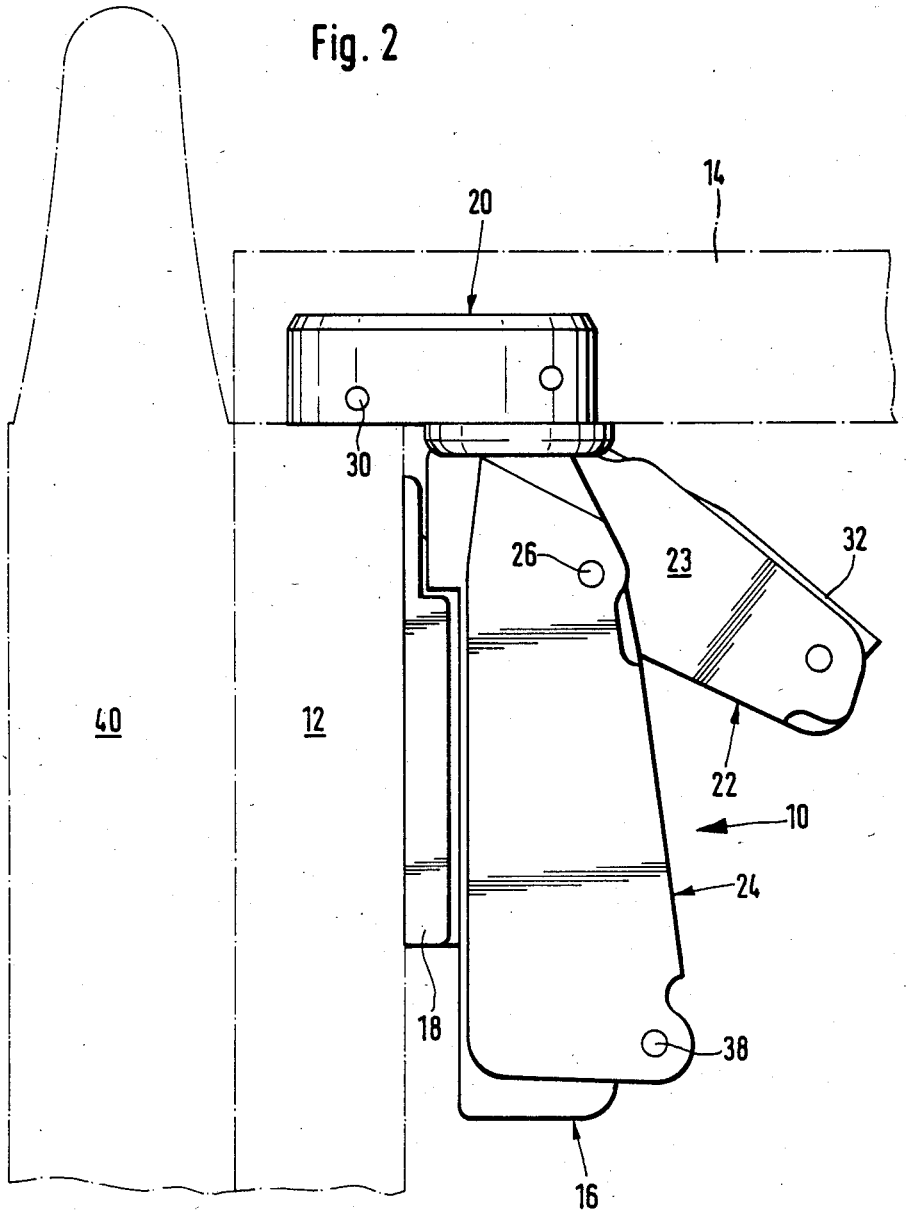

The embodiment of a crosslink hinge 10 of the invention, represented in the drawings, serves for hanging a door leaf 14 on a supporting wall 12 of a cabinet carcass. The supporting-wall-related part 16 of the hinge 10 is fastened to the supporting wall in the usual way by means of a mounting plate 18. The door-related part 20 has the also common form of a cup for insertion in a mortise, which can be made of plastic by the injection molding process or of metal.

The crosslink is formed by two link arms 22 and 24, each having parallel flanges 23 and 25, respectively; they are pivoted on one another in their middle portion on a pivot pin 26, the insides of the flanges 25 of link arm 24 straddling the outsides of the flanges 23 of link arm 22 with a slight clearance. The link arm 22 is pivoted on the supporting-wall-related part 16 on a pivot pin 28 (FIGS. 3 and 4) and link arm 24 is pivoted on the door-related part 20 by means of a pivot pin 30. A swinging lever 32 is articulated to the other end of link arm 22, and at the other end to the door-related part 20 and it guides this end of the link arm 22 on an arcuate path. The second end of the link arm 24 is likewise coupled to the supporting-wall-related part 16 by a swinging lever 34; the swinging lever 34 is articulated to the supporting-wall-related part 16 on a pivot pin 36, and between the flanges 25 of the link arm 24 on a pivot pin 38.

Up to this point the described hinge 10 corresponds to known crosslink hinges. Hinge 10, however, is designed for applications in which it must provide a comparatively greater component of movement outwardly from the cabinet carcass, which is indicated in FIGS. 1 to 4 by a projecting molding 40 represented beside the actual supporting wall 12 of the cabinet carcass, these being represented in the drawing in broken lines, the same as the supporting wall 12 and the door leaf 14. While the opening outthrust in question is only sufficient in normal crosslink hinges to correspond approximately to the thickness of the door leaf that is to be hung with the hinge, so that the door hung with the hinge can be thrust out and away from the (closed) door of an adjacent cabinet when it is open all the way, it is apparent that the opening outthrust of the crosslink hinge 10 of the invention is about twice as great. This is achieved by the fact that the supporting-wall-related part 16 is composed of a bottom piece 42 that is to be fastened in the conventional manner on the mounting plate 18 and a top piece 44 guided displaceably on the bottom piece 42 in the direction of the opening outthrust, the direct articulation of the link arm 22 on the supporting-wall-related part being accomplished by means of the pivot pin 28 at the front end of the top piece 44, and also the articulation of the supporting-wall end of the swinging arm 34 coupling the other link arm 24 indirectly with the supporting-wall-related part is provided on the top piece 44. Since the displacement of the top piece 44 relative to the bottom piece 42 is intended to supply the desired additional opening outthrust, the top piece 44, which is in the shape of an inverted U in cross section, is longer than the bottom piece 42, which is only so long that it fits on the mounting plate 18 within the required range of adjustment. The lateral flanges 48 of the top piece 44, which are formed by the above-mentioned inverted U shape, and are joined at the upper end by a web 46 (which has an opening for reasons to be explained below), straddle the lateral surfaces 50 of the bottom piece 42 and additionally reach underneath the lower margins, i.e., those facing the supporting wall, of the lateral surfaces 50 by means of the inwardly turned rims 52 of the flanges 48; these rims can clearly be seen in the cross section represented in FIG. 5. The articulation of the swinging lever 34 on the top piece 44 by means of pivot pin 36 is situated between two pivot lugs 54 which are prolongations of flanges 48 beyond the web 46 of the top piece 44.

Figure 3:
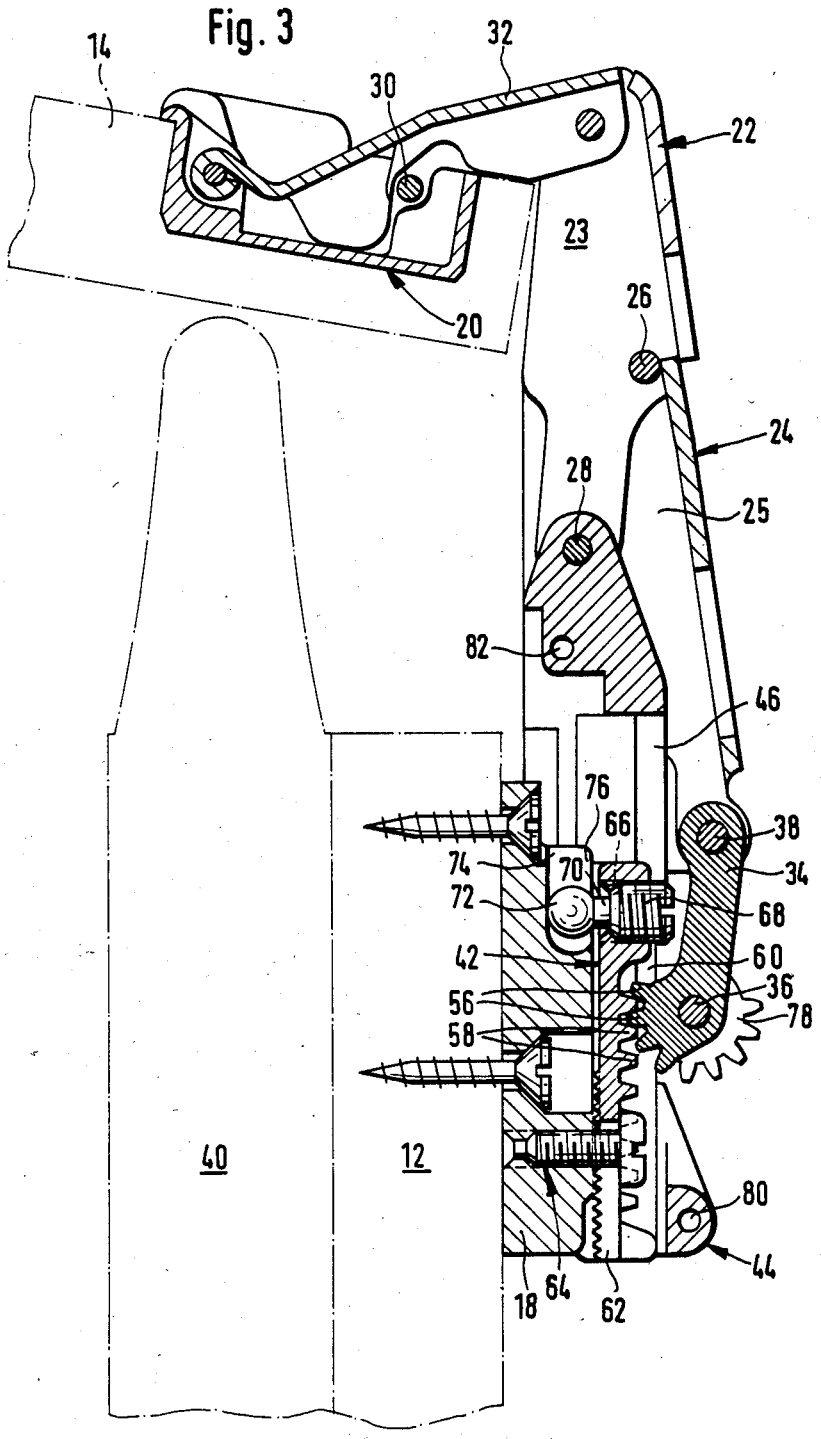
FIGS. 3 and 4 are longitudinal central sections through FIGS. 1 and 2.
Figure 4:
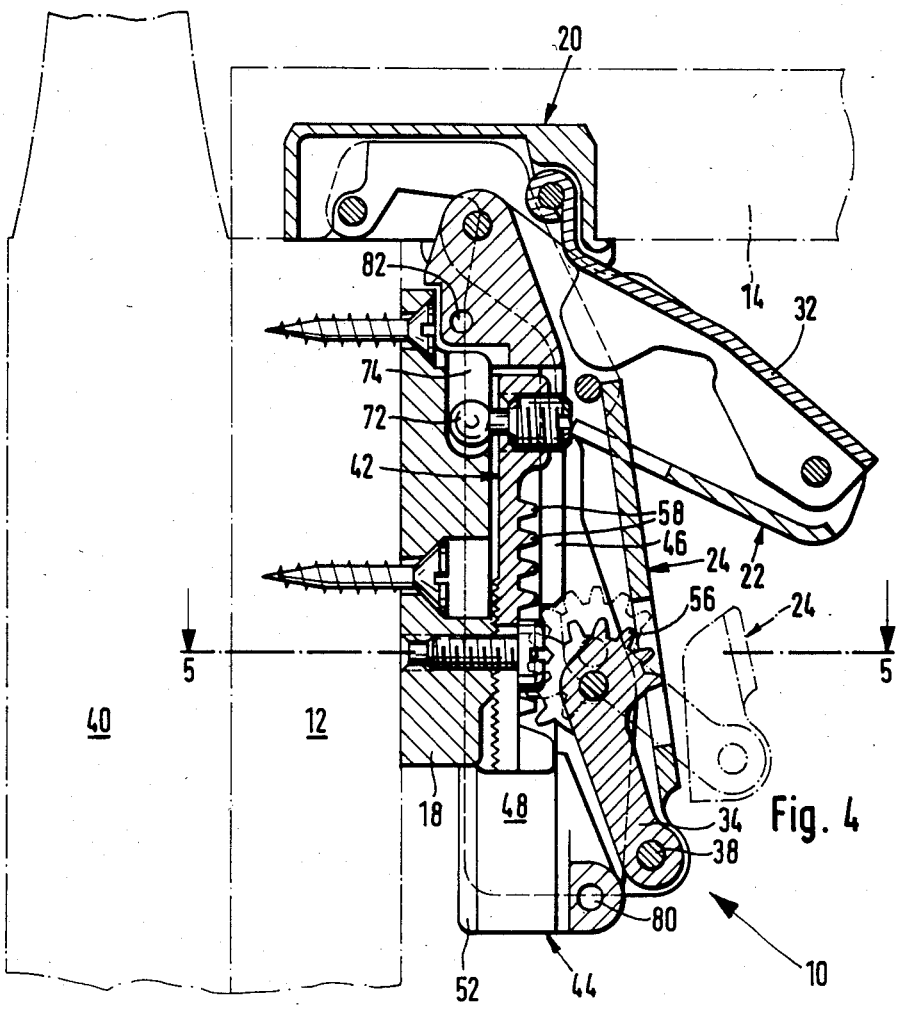
Figure 5:
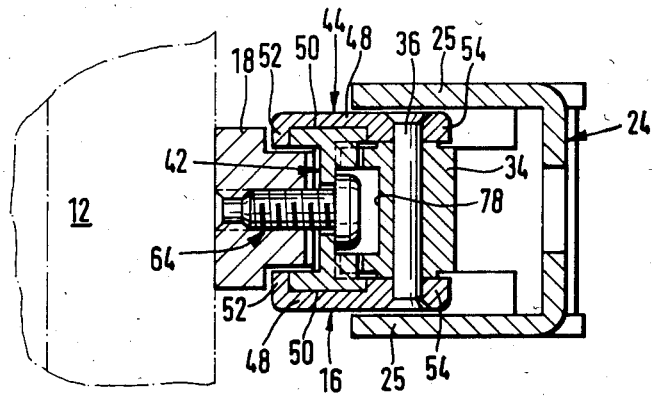
FIG. 5 is a section along the arrows 5—5 in FIG. 4.

The end of swinging lever 34 that is pivoted between the pivot lugs 54 is in the form of a gear segment 56 whose teeth mesh with the teeth of a rack section 58 provided on the top of the bottom piece 42 (FIGS. 3 and 4). By this gearing, the top piece and bottom piece of the supporting-wall-related part of the hinge are thus positively coupled for movement, the position of the top piece on the bottom piece in the longitudinal direction being dependent upon the pivot angle of the swinging lever 34. Since, when the door is opened, the swinging lever 34 swings forward out of the carcass interior, the resultant rotation of the gear segment 56 also displaces the top piece 44 relative to the bottom piece 42 in the direction outward from the carcass interior, and this achieves the additional opening outthrust in comparison to ordinary crosslink hinges. It is clear that the web 46 of the top piece 44 must be provided with an opening 60 through which the gear segment 56 engages the rack 58. In the embodiment shown in the drawing, this opening 60 extends over the greater part of the length of the top piece 44, in order additionally to assure access to the adjusting and fastening screws by which the bottom piece 42 is fastened on the mounting plate 18 in the manner described below.

The bottom piece 42 has in its end portion remote from the door leaf, i.e., in its carcass-interior end portion, a slot 62 open at the rearward end, through which passes the shank of a locking screw 64 driven into the mounting plate 18. Toward the front end or door end of the bottom piece 42 there is provided a tap 66 into which a set screw 68 is threaded, on whose bottom end facing the mounting plate 18 a ball 72, connected to the screw by a short neck section of reduced diameter, is integrally formed.

The mounting plate 18 is provided, in the area beneath the tap 66, with a channel 74 which is open at the end adjacent the door leaf and narrowed at its surface opening 76 to a width that is about equal to or only slightly wider than the diameter of the neck 70 of the set screw 68. Below the narrowed opening 76 the channel 74 has a circular cross section whose diameter is approximately equal to the diameter of the ball 72. The bottom piece 42 is installed, therefore, simply by sliding it, with the set screw 64 loose, parallel to the supporting wall 12 with its rear slot 62 under the head of the locking screw 64, the ball 72 entering the open end of the channel 74. Within the area determined by the length of slot 62 and of the channel 74, the bottom piece 42 and thus the entire supporting-wall-related part 16 of hinge 10 can then be displaced longitudinally, parallel to the surface of the supporting wall 12. By tightening the locking screw 64, the bottom piece can then be clamped against the mounting plate 18. By turning the set screw 68, the bottom piece 42 and thus the supporting-wall-related part 16 can be raised and lowered relative to the mounting plate 18, thus making the overlap dimension of the door leaf 14 on the front edge surface of the supporting wall 12 variable. Since the slot 62 centrally interrupts the rack 58 at the carcass-internal end of the bottom piece 42, and the head of the locking screw 64 protrudes in this interrupted portion, the gear segment 56 on the swinging lever 34 is relieved in the central portion 78 passing over the slot 62 during the swinging movement of the swinging lever such that the head of the locking screw 64 can pass underneath the open middle section.

The bottom piece 42 and the top piece 44 of the hinge 10 are best made of metal by die casting. To avoid the need for a complex die for the top piece 44, it may be desirable to make it from two mirror-image symmetrical halves which are screwed or riveted together instead of making it in one piece. The bores 80 and 82 represented in FIGS. 3 and 4 on the back and front end of the top piece 44 might serve, for example, for the riveting together of the halves of the top piece.

It is apparent that modifications and improvements of the embodiment described can be made within the scope of the invention. Thus, the bottom piece 42 can, of course, be modified such that the hinge can be fastened on a monting plate of a different configuration from mounting plate 18. It is important only that the supporting-wall-related hinge part is composed of a bottom piece and a top piece guided for longitudinal displacement thereon, the top piece and bottom piece being positively coupled for movement by the teeth on the swinging lever and on the bottom piece such that the hinge will perform a greater outthrusting movement upon opening than conventional crosslink hinges.

I claim:

1. A crosslink hinge for hanging a door on a supporting wall of a furniture carcass, said hinge having a door-related part, and also a supporting-wall-related part adjustably fastenable to a mounting plate on the supporting wall, two elongated link arms joining said door-related part and said supporting wall-related part to each other, said arms being coupled to one another in a central area of said arms for rotation relative to one another, said arms each having two opposite ends, one end of each arm being articulated directly for rotation on one hinge part and the other end being coupled with the other hinge part, said supporting-wall-related part comprising a bottom piece to be fastened on the mounting plate, and a top piece guided for displacement on the bottom piece relative to the bottom piece towards and away from the door-related part, a swinging lever having one end pivotally coupled to said one end of the link arm articulated directly to the door-related part and another end pivotally connected to said top piece, and a gear segment formed on the another end of the swinging lever, said bottom piece having a rack section for meshing with said gear segment so that swinging movement of the gear segment relative to said rack section will transmit into movement of the top piece relative to the bottom piece.

2. A crosslink hinge according to claim 1, wherein said bottom piece has an open slot in an end portion thereof remote from said door-related part, a locking screw having a head, and also a threaded shank portion passing through said slot and into the mounting plate, and a tap in said bottom piece at a location offset in the direction towards said door-related part relative to said slot, a channel in said mounting plate and having an opening adjacent said door-related part, and a narrowed mouth, a set screw threaded into said tap and bearing a holding means enlarged in diameter received in said channel, and a neck portion received in said narrowed mouth for securing said holding means against being lifted off from said channel, said gear segment having a relieved portion where it passes over said slot during hinge opening and closing movement, said relieved portion having a width corresponding approximately to the width of the head of the locking screw passing through the slot, such that the head can pass beneath the relieved portion.

3. A crosslink hinge according to claim 2, wherein said top piece is elongated and has an inverted U cross section with two lateral flanges joined by a web, said bottom piece being elongated and having side surfaces accommodated between said flanges, said flanges having longitudinal ribs projecting toward each other and catching underneath said surfaces for holding said two pieces to each other.

4. A crosslink hinge according to claim 3, wherein said lateral flanges have adjacent said other end of the swinging lever pivot lugs projecting beyond the web, said web having an opening between the pivot lugs through which said gear segment engages the rack section.

5. A crosslink hinge according to claim 1, wherein said top piece is elongated and has an inverted U cross section with two lateral flanges joined by a web, said bottom piece being elongated and having side surfaces accommodated between said flanges, said flanges having longitudinal ribs projecting toward each other and catching underneath said side surfaces for holding said two pieces to each other.

6. A crosslink hinge according to claim 5, wherein said lateral flanges have adjacent said other end of the swinging lever pivot lugs projecting beyond the web, said web having an opening between the pivot lugs through which said gear segment engages the rack section.

7. A crosslink hinge according to claim 1, wherein said top piece is composed of two halves of mirror-image symmetry divided approximately along a longitudinal central plane running centrally between and parallel to said flanges.

8. A crosslink hinge according to claim 7, wherein said top piece halves have bores running at right angles to the plane of separation.

* * * * *

UNITED STATES PATENT AND TRADEMARK OFFICE

CERTIFICATE OF CORRECTION

PATENT NO. : 4,584,738

DATED : April 29, 1986

INVENTOR(S) : Reinhard Lautenschlager

It is certified that error appears in the above-identified patent and that said Letters Patent are hereby corrected as shown below:

Title Page, Item [30] should be added:

-- Foreign Application Priority Data

February 28, 1984 [DE] Fed.Rep.of Germany ... 3407174 --

Signed and Sealed this

*Twelfth* Day of *August 1986*

[SEAL]

*Attest:*

DONALD J. QUIGG

*Attesting Officer*

*Commissioner of Patents and Trademarks*